US009179225B2

(12) United States Patent
Takagi

(10) Patent No.: US 9,179,225 B2
(45) Date of Patent: Nov. 3, 2015

(54) HEARING AID DEVICE

(71) Applicant: Panasonic Corporation, Osaka (JP)

(72) Inventor: Yoshiaki Takagi, Ehime (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 147 days.

(21) Appl. No.: 13/937,556

(22) Filed: Jul. 9, 2013

(65) Prior Publication Data

US 2014/0016805 A1 Jan. 16, 2014

(30) Foreign Application Priority Data

Jul. 13, 2012 (JP) ..... 2012-157195
Jun. 21, 2013 (JP) ..... 2013-130761

(51) Int. Cl.
*H04R 25/00* (2006.01)

(52) U.S. Cl.
CPC ..... *H04R 25/552* (2013.01); *H04R 25/50* (2013.01); *H04R 2225/43* (2013.01); *H04R 2225/61* (2013.01); *H04R 2430/03* (2013.01)

(58) Field of Classification Search
CPC . H04R 25/505; H04R 25/552; H04R 2225/43
See application file for complete search history.

(56) References Cited

U.S. PATENT DOCUMENTS

| | | | | |
|---|---|---|---|---|
| 8,374,877 | B2 | 2/2013 | Fusakawa et al. | |
| 2002/0118846 | A1* | 8/2002 | Narusawa | 381/103 |
| 2007/0269065 | A1* | 11/2007 | Kilsgaard | 381/315 |
| 2008/0082327 | A1 | 4/2008 | Murase et al. | |
| 2011/0004468 | A1 | 1/2011 | Fusakawa et al. | |
| 2012/0250915 | A1 | 10/2012 | Takagi et al. | |

OTHER PUBLICATIONS

Y. Suzuki et al., "Determination of Filtering Parameters for Dichotic-Listening Binaural Hearing Aids", Acoustics 08 Paris (France), Jun. 29-Jul. 4, 2008, pp. 1153-1158.

* cited by examiner

*Primary Examiner* — Matthew Eason
(74) *Attorney, Agent, or Firm* — Wenderoth, Lind & Ponack, L.L.P.

(57) ABSTRACT

A hearing aid device with a dichotic function comprises a first sound input/output component having a first microphone configured to be worn on one ear, a second sound input/output component having a second microphone configured to be worn on the other ear, and a dichotic setting component. The dichotic setting component determines the occurrence of time masking according to a sound signal inputted from the first microphone or the second microphone, and activates or deactivates the dichotic function according to this determination result. The hearing aid device improves the hearing aid effect.

7 Claims, 9 Drawing Sheets

FIG. 2A
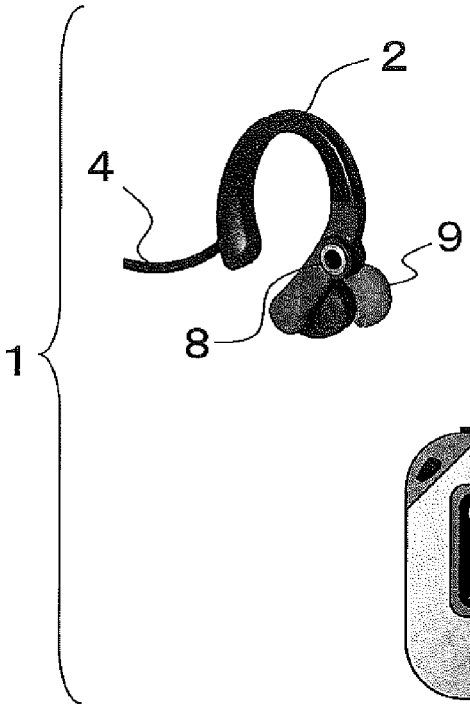
FIG. 2B
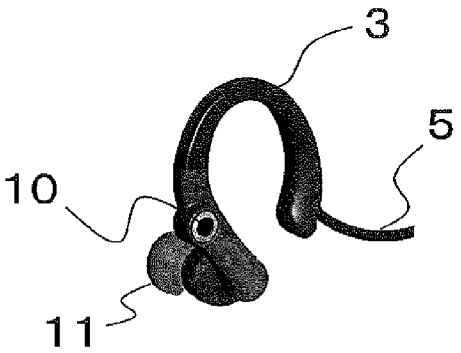
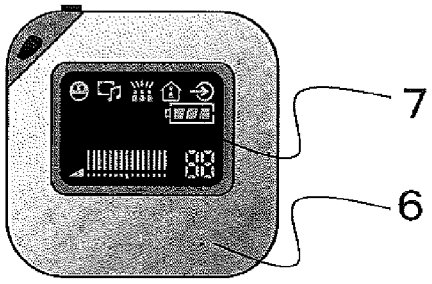
FIG. 2C

EXAMPLE OF DETERMINATION TABLE

| SPEECH RATE | POWER RATIO | | |
|---|---|---|---|
| | LESS THAN 1/3 | 1/3 TO 2/3 | GREATER THAN 2/3 |
| FEWER THAN 8 WORDS/SECOND | LOW RISK | LOW RISK | HIGH RISK |
| 8 TO 12 WORDS/SECOND | LOW RISK | HIGH RISK | HIGH RISK |
| MORE THAN 12 WORDS/SECOND | LOW RISK | HIGH RISK | HIGH RISK |

FIG. 9

HEARING AID DEVICE

PRIORITY

This application claims priority under 35 U.S.C. §119 to Japanese Patent Applications No. 2012-157195 filed on Jul. 13, 2012 and No. 2013-130761 filed on Jun. 21, 2013. The entire disclosure of Japanese Patent Applications No. 2012-157195 and No. 2013-130761 is hereby incorporated herein by reference.

BACKGROUND OF THE INVENTION

1. Field of the Invention

This disclosure relates to a hearing aid device.

2. Description of the Related Art

Hearing aid devices developed for people with hearing impairment use a gain controller to amplify sound picked up by a microphone, and output louder sound from a speaker. This has made it much easier for patients to recognize sounds. However, when a gain controller is used to amplify sound picked up by a microphone, and a louder sound is merely emitted from a speaker in this way, the hearing aid effect may not be adequate, particularly in terms of understanding a conversation. One reason for this is that speech is made up of vowels (bass) and consonants (treble). Specifically, a hearing-impaired person often finds it particularly difficult to hear sounds in the high-frequency band, that is, consonants. Such inability to pick up consonants impedes the person's ability to follow a conversation.

One way to deal with this problem is to further raise the amplification of the gain controller. However, when the amplification is thus raised, the sound pressure (volume, sound level) also rises for vowels, which creates a situation in which the consonants are drowned out in the vowels (called masking), and as a result, the hearing aid effect is inadequate for following a conversation, as discussed above. In view of this, in the following Non-Patent Literature 1 there is proposed a dichotic hearing aid in which a first hearing aid worn on one ear is used for low pitch sounds, and a second hearing aid worn on the other ear is used for high pitch sounds. That is, the user hears the vowels (low pitch sounds) in a conversation with the first hearing aid, and hears the consonants in a conversation (high pitch sounds) with the second hearing aid. The user's brain merges these into a single sound, and this makes conversation easier to understand.

Non-Patent Literature 1: Y. Suzuki et al., "Determination of Filtering Parameters for Dichotic-Listening Binaural Hearing Aids," Acoustic 08 Paris (France), 2008

As discussed above, with what is discussed in Non-Patent Literature 1, a first hearing aid that is worn on one ear is used for low pitch sounds (vowels), and a second hearing aid that is worn on the other ear is used for high pitch sounds (consonants). As a result, there is no masking due to low pitch sounds (vowels) with the second hearing aid used for high pitch sounds (consonants), which means that conversation can be heard more clearly.

Nevertheless, depending on the voice characteristics, the above-mentioned dichotic hearing aid may not always afford a sufficient clarity improvement effect.

SUMMARY OF THE INVENTION

This disclosure provides a hearing aid device with which conversation can be heard more clearly.

The hearing aid device according to this disclosure with a dichotic function comprises a first sound input/output component including a first microphone configured to be worn on one ear of a user of the hearing aid device, a second sound input/output component including a second microphone configured to be worn on the other ear of the user, and a dichotic setting component. The dichotic setting component is configured to determine an occurrence of time masking according to a sound signal inputted from the first microphone or the second microphone, and either activate or deactivate the dichotic function according to the determination result.

The hearing aid device disclosed herein allows the user to hear conversation more clearly.

BRIEF DESCRIPTION OF DRAWINGS

FIG. 2A shows a sound input/output component that is worn on the right ear of a user; FIG. 2B shows a sound input/output component that is worn on the left ear of a user; FIG. 2C shows a signal processor;

FIG. 9 is a table of determination patterns in Embodiment 3.

DETAILED DESCRIPTION OF THE INVENTION

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Embodiment 1

1-1. Configuration

Figure 1:
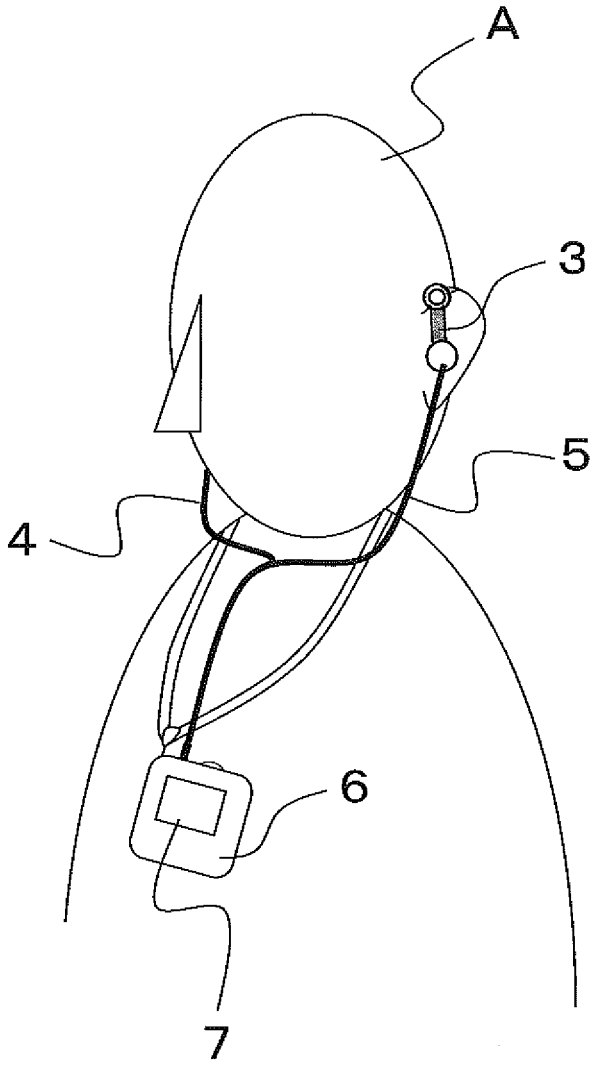
FIG. 1 shows how the hearing aid device pertaining to an embodiment of the present invention is used.

FIG. 1 shows the hearing aid device 1 in this embodiment (an example of a hearing aid device). As can be seen from FIGS. 1 and 2, this hearing aid device 1 comprises a sound input/output component 2 (an example of a first sound input/output component) that is worn on the right ear of a user A, a sound input/output component 3 (an example of a second sound input/output component) that is worn on the left ear of the user A, and a signal processor 6 that is electrically connected via lead wires 4 and 5 to the sound input/output components 2 and 3.

As shown in FIG. 2, the right-ear sound input/output component 2 connected by the lead wire 4 to the signal processor 6 has a microphone 8 and a speaker 9. Similarly, the left-ear sound input/output component 3 connected by the lead wire 5 to the signal processor 6 has a microphone 10 and a speaker 11. The signal processor 6 is equipped with a display component 7.

Figure 3:
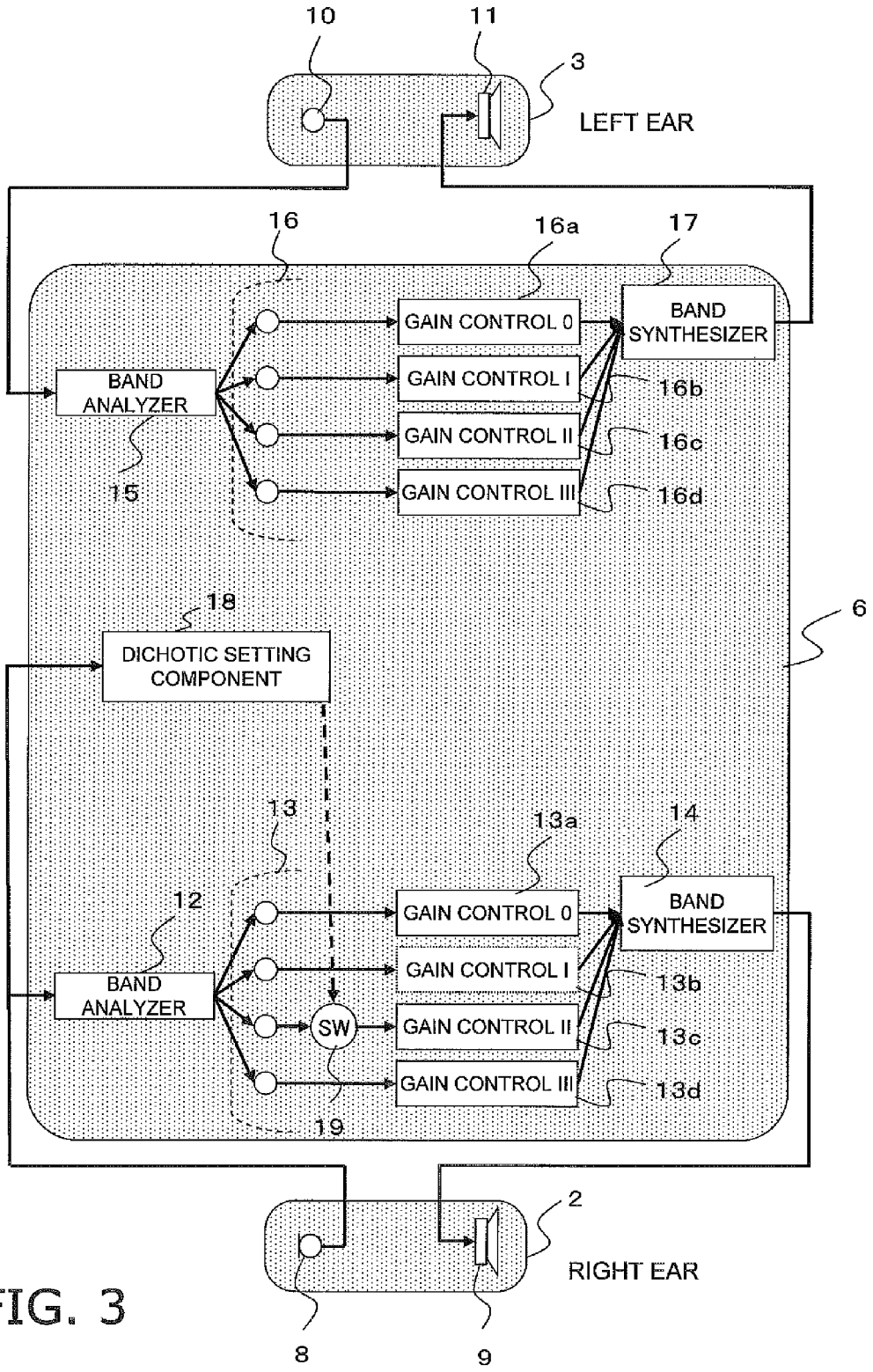
FIG. 3 is a block diagram of Embodiment 1.

FIG. 3 shows the electrical control blocks of the hearing aid device 1, and shows the connection state between the microphone 8 and speaker 9 of the sound input/output component 2 worn on the right ear, and the connection state between the microphone 10 and speaker 11 of the sound input/output component 3 worn on the left ear.

The signal processor 6 has a band analyzer 12, a gain controller 13, and a band synthesizer 14, which are connected to the sound input/output component 2 worn on the right ear.

The band analyzer 12 splits the sound picked up by the microphone 8 of the sound input/output component 2 into four frequency bands.

The gain controller 13 (13*a*, 13*b*, 13*c*, and 13*d*) is connected to the band analyzer 12 and performs gain control on the bands split by the band analyzer 12. The gain controller 13 operates a switch 19 according to commands from a dichotic setting component 18 (discussed below) to set the gain for the high pitch sound bands obtained by the band analyzer 12 higher than the gain for the low pitch sound bands. This activates a dichotic function in which the sound input/output component 3 serves as a hearing aid component for high pitch sound bands.

The band synthesizer 14 is connected to the gain controller 13 and outputs speech that has undergone gain control by the gain controller 13 to the speaker 9.

The signal processor 6 also has a band analyzer 15, a gain controller 16, and a band synthesizer 17, which are connected to the sound input/output component 3 worn on the left ear.

The band analyzer 15 splits the sound picked up by the microphone 10 of the sound input/output component 3 into four frequency bands.

The gain controller 16 (16*a*, 16*b*, 16*c*, and 16*d*) is connected to the band analyzer 15 and performs gain control on the bands split by the band analyzer 15.

The gain controller 17 is connected to the gain controller 16 and outputs sound that has undergone gain control by the gain controller 16 to the speaker 11.

The signal processor 6 further has the dichotic setting component 18 (an example of a dichotic setting component) and a switch 19. The dichotic setting component 18 analyzes sound picked up by the microphone 8, determines whether to activate or deactivate the dichotic hearing aid function, and then activates or deactivates the dichotic hearing aid function with the switch 19 according to the determination result. The switch 19 switches to activate or deactivate the dichotic hearing aid function according to commands from the dichotic setting component 18.

1-2. Operation

In Embodiment 1 we will focus on first formants that are included in speech inputted from the microphone 8. Formants are peaks included in the frequency spectrum of speech, and the second peak from the lowest frequency is called a first formant. For example, in FIG. 4, the spectrum indicated with a bold line is the result of subjecting the waveform of a sound signal to Fourier transform, and plotting amplitude on the vertical axis and frequency on the horizontal axis. It can be seen that there are four peaks in this spectrum. Of these peaks, the second peak portion from the low frequency side is the first formant. Although opinion is divided regarding the frequency band of a first formant, in this embodiment it is treated as a range from 300 Hz to 1 kHz, as indicated by the hatched portion in FIG. 4.

Figure 4:
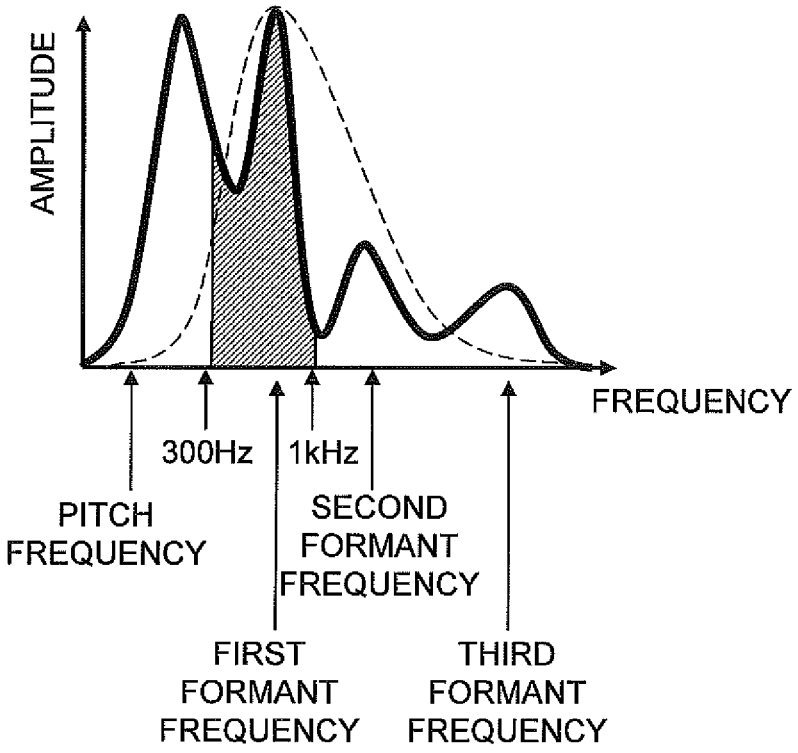
FIG. 4 is a spectral graph of the speech waveform in Embodiment 1.

Masking occurs if this first formant has a high power. Specifically, frequency masking occurs. For example, the curve indicated by the dotted line in FIG. 4 shows the region in which there is masking by the first formant, and it can be seen that a second formant is buried in this region. This makes it difficult to hear sounds in the frequency band of the second formant, and as a result it is harder to understand words. With a sound signal such as this, an improvement in hearing can be achieved by using a dichotic hearing aid.

In view of this, in Embodiment 1, the power of the entire frequency band of a sound signal and the power of the first formant are calculated, and the dichotic function is either activated or deactivated according to the ratio of these power levels.

Figure 5:
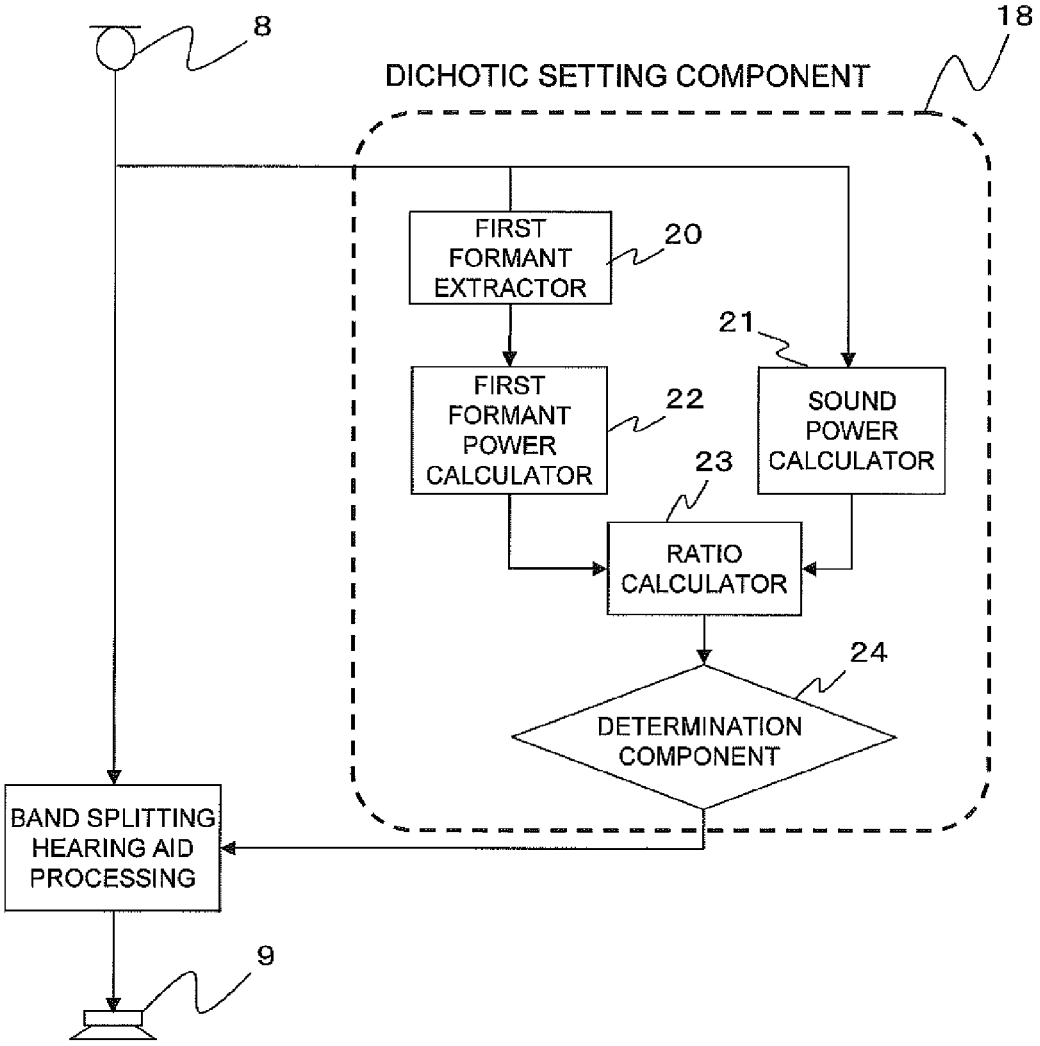
FIG. 5 is a block diagram of the dichotic setting component in Embodiment 1.

The specific configuration will be described through reference to the block diagram of the dichotic setting component 18 in FIG. 5.

The dichotic setting component 18 has a first formant extractor 20 (an example of a first formant extractor), a sound power calculator 21 (an example of a sound power calculator), a first formant power calculator 22 (an example of a first formant power calculator), a ratio calculator 23 (an example of a ratio calculator), and a determination component 24. Some or all of the functions of the first formant extractor 20, the sound power calculator 21, the first formant power calculator 22, the ratio calculator 23, and the determination component 24 are executed according to specific programs read out by a processor from a memory or the like.

The sound signal inputted from the microphone 8 is inputted in parallel to the first formant extractor 20 and the sound power calculator 21. The first formant extractor 20 extracts from the inputted sound signal a first formant that is in a frequency band of from 300 Hz to 1 kHz, for example (see FIG. 4), and outputs this first formant to the first formant power calculator 22. The first formant power calculator 22 calculates the power of the frequency band of the inputted first formant. The "power" referred to here is the surface area of the region that is hatched as the first formant in the graph in FIG. 4.

The sound power calculator 21 calculates the surface area of the total frequency band of the inputted sound signal as the power.

The ratio calculator 23 compares the power (area) of the total frequency band inputted from the sound power calculator 21 with the power (area) of the first formant inputted from the first formant power calculator 22, calculates the ratio thereof, and outputs the result to the determination component 24.

With the determination component 24, the switch 19 is operated to activate the dichotic function if the power of the first formant is at least one-half the power of the total frequency band, which is an example of a threshold for the occurrence of masking, or deactivate the dichotic function otherwise.

With this system, the dichotic function can be activated only when a sound signal is inputted that affords a good effect of improving hearing through a dichotic action.

In Embodiment 1, whether to activate or deactivate the dichotic function is determined from a comparison of the power (area) of the first formant and the power (area) of the total frequency band, but this is not the only option. The technique here is to determine whether or not masking occurs, so this determination may be made by some other method, such as one involving the height of the amplitude of the first formant.

1-3. Effect, Etc.

The hearing aid device 1 in this embodiment distinguishes between when the effect of a dichotic function is obtained and when an adequate effect is not obtained, and allows the dichotic function to be activated or deactivated. Therefore, the dichotic function can be utilized more effectively in the hearing aid device 1, and as a result the user of the hearing aid device 1 can hear conversation more clearly, which means that the hearing aid device 1 is expected to find wide application.

Embodiment 2

In Embodiment 2, we will describe the control of the dichotic function by means of other characteristics of a sound signal. Those constituent elements that are the same as in Embodiment 1 will be numbered the same, and new numbering will be given only for the constituent elements inside the dichotic setting component 18, which includes constituent elements different from those in Embodiment 1.

One of the other characteristics of a sound signal that can make conversation hard to hear is the speed at which a person speaks. This is because when a person speaks rapidly, the next sound comes out while the effect of the preceding loud sound still remains, which causes masking to occur, in which the next sound is drowned out by the preceding loud sound. Specifically, time masking occurs.

Therefore, in Embodiment 2 we will describe a technique for controlling whether the dichotic function is activated or deactivated by detecting the speech rate.

Figure 6:
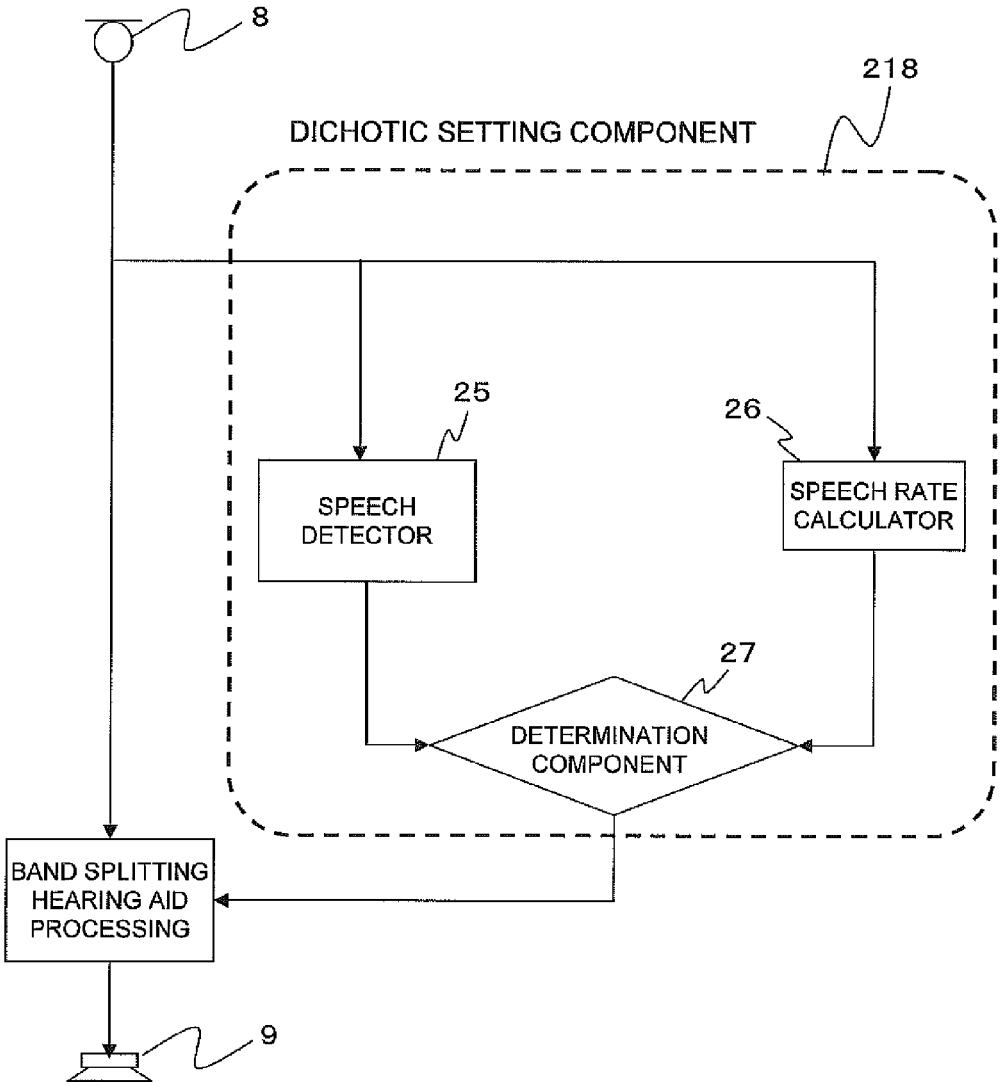
FIG. 6 is a block diagram of the dichotic setting component in Embodiment 2.

FIG. 6 is a block diagram of a dichotic setting component 218 in Embodiment 2.

The dichotic setting component 218 has a speech detector 25 (an example of a speech detector), a speech rate calculator 26 (an example of a speech rate calculator), and a determination component 27. Some or all of the functions of the speech detector 25, the speech rate calculator 26, and the determination component 27 are executed according to specific programs read out by a processor from a memory or the like.

The sound signal inputted from the microphone 8 is inputted in parallel to the speech detector 25 and the speech rate calculator 26. The speech detector 25 determines whether or not the inputted sound signal includes a human voice, and outputs the result to the determination component 27. The speech rate calculator 26, which will be described in detail below, measures the amplitude speed from the inputted sound signal and calculates the speech rate as a result.

The determination component 27 operates the switch 19 to activate the dichotic function if the speech rate that is the output result from the speech rate calculator 26 is higher than a specific rate when information indicating a human voice has been inputted from the speech detector 25, and deactivates the dichotic function otherwise.

Figure 7A:
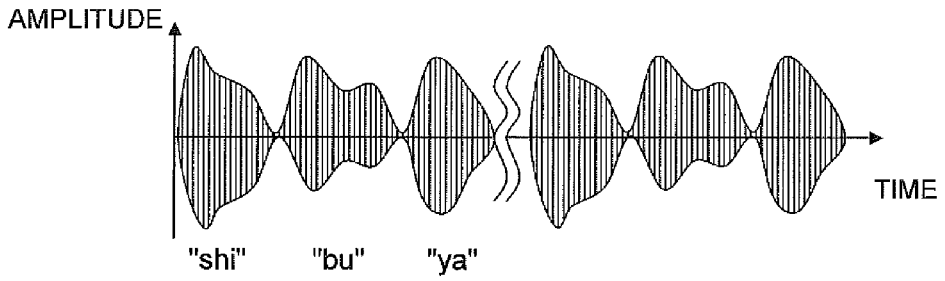
FIGS. 7A, 7B, and 7C consist of graphs of speech waveforms in Embodiment 2.
Figure 7B:
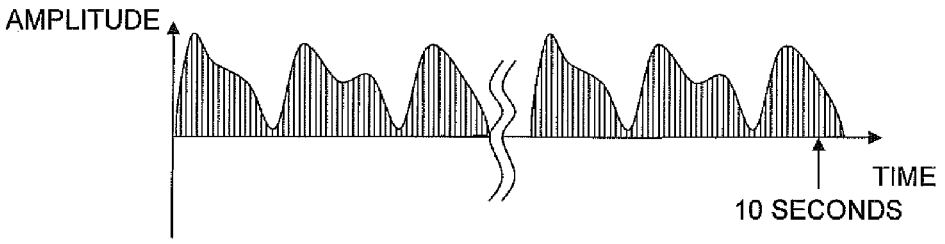

The speech rate calculation that is a function of the speech rate calculator 26 will now be described through reference to FIG. 7. First, if we assume that the sound signal inputted from the microphone 8 is, for example, speech including the place name "Shibuya . . . ," then envelopes linking the waveform peaks corresponding to "shi," "bu," and "ya" appear as waveform groupings as shown in FIG. 7A. In order to recognize the sounds one by one in this manner, first the waveforms in FIG. 7A are subjected to half-wave rectification as in FIG. 7B.

The maximum amplitude that appears within a specific length of time (approximately 10 seconds in this example) within the waveforms is then detected. The half-amplitude of the detected maximum amplitude is utilized as a threshold, and the waveforms that exceed this threshold are counted. Since sound volume and distance from the speaker do not remain constant, the threshold is preferably updated every 10 seconds, for example.

Figure 7C:
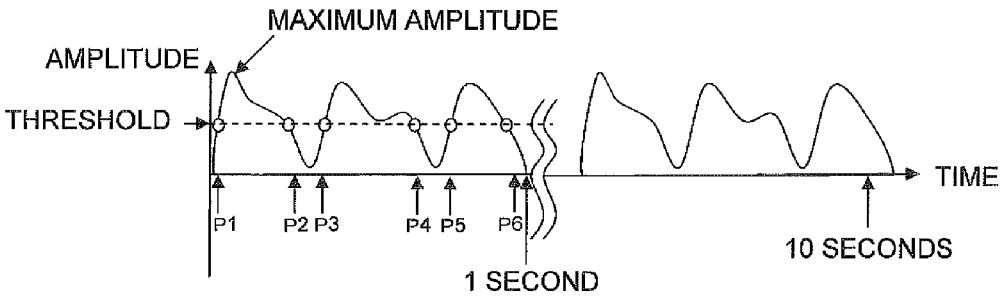

Next, the amount for counting words will be described through reference to FIG. 7C. The dotted line in FIG. 7C is a threshold indicating the timing at which the waveforms are counted. Words are counted by counting the points at which the waveforms intersect this threshold. The waveform of a sound is counted twice for one word, since a peak of one waveform is formed for "shi," for example, and each time the threshold is exceeded on the rise and fall of the waveform is counted.

In this example, the words produced in one second are counted, and there are a total of six points (P1 to P6) at which the dotted line and the waveforms intersect. The actual number of words is therefore one half this number, or three words.

With this method for counting words, the speech rate can be considered to be high if there are at least 20 points (10 words) per second. In that case, the determination component 27 operates the switch 19 to activate the dichotic function.

Hearing can be improved by thus controlling the activation or deactivation of the dichotic function according to the speech rate.

Embodiment 3

In Embodiment 3 we will describe the control of the dichotic function through a combination of Embodiments 1 and 2. Again in Embodiment 3, those constituent elements that are the same as in Embodiment 1 or 2 will be numbered the same, and new numbering will be given only for the constituent elements inside the dichotic setting component 18, which includes constituent elements different from those in Embodiment 1 or 2.

Figure 8:
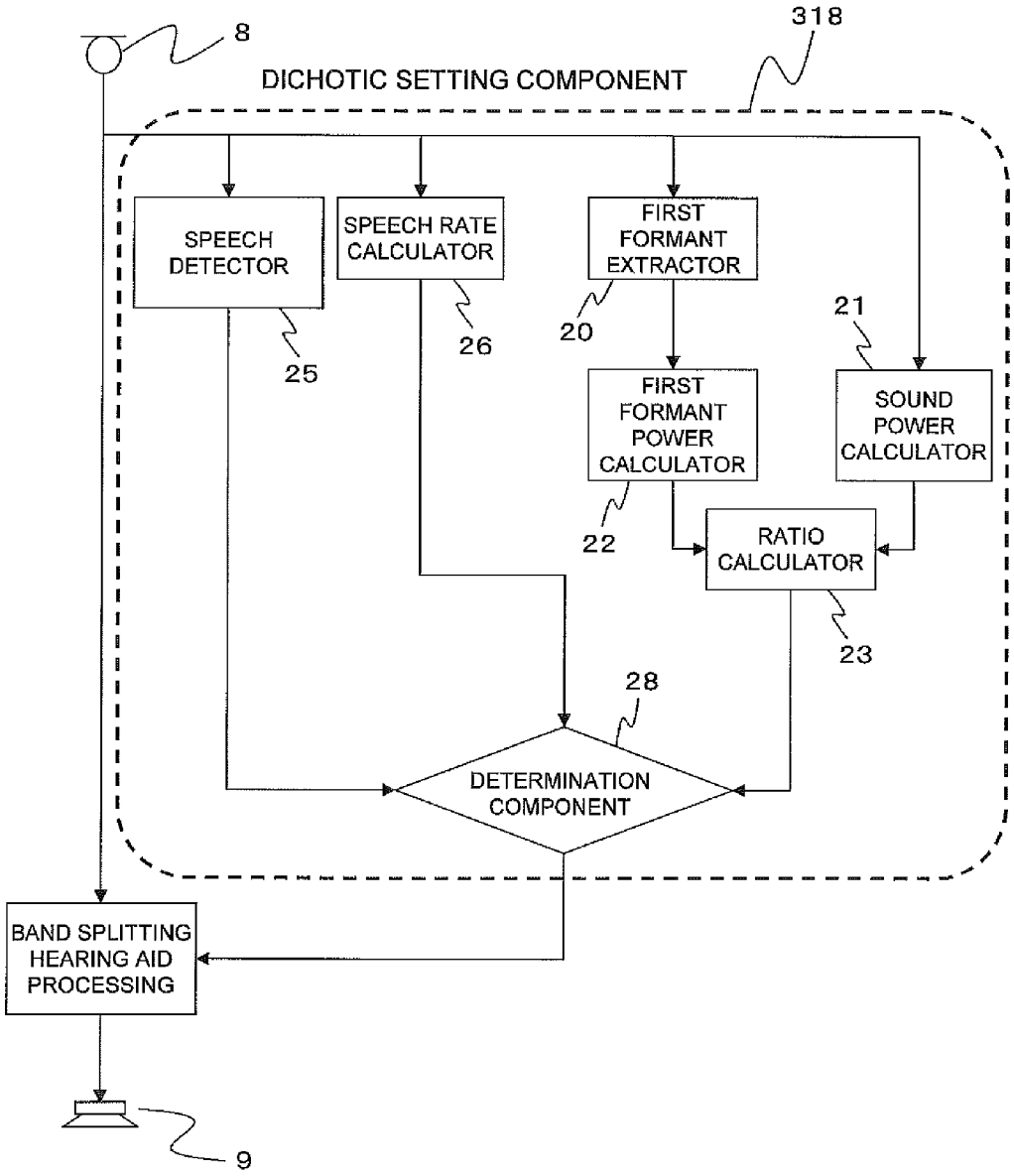
FIG. 8 is a block diagram of the dichotic setting component in Embodiment 3.

FIG. 8 is a block diagram of a dichotic setting component 318.

The dichotic setting component 318 has a first formant extractor 20 (an example of a first formant extractor), a sound power calculator 21 (an example of a sound power calculator), a first formant power calculator 22 (an example of a first formant power calculator), a ratio calculator 23 (an example of a ratio calculator), a speech detector 25 (an example of a speech detector), a speech rate calculator 26 (an example of a speech rate calculator), and a determination component 28. Some or all of the functions of the first formant extractor 20, the sound power calculator 21, the first formant power calculator 22, the ratio calculator 23, the speech detector 25, the speech rate calculator 26, and the determination component 28 are executed according to specific programs read out by a processor from a memory or the like.

First, just as in Embodiment 1, the sound signal inputted from the microphone 8 is inputted in parallel to the first formant extractor 20 and the sound power calculator 21. The first formant extractor 20 extracts from the inputted sound signal a first formant that is in a frequency band of from 300 Hz to 1 kHz, for example (see FIG. 4), and outputs this first formant to the first formant power calculator 22. The first formant power calculator 22 calculates the power of the frequency band of the inputted first formant. The sound power calculator 21 calculates the power of the total frequency band of the inputted sound signal. The ratio calculator 23 compares the power of the total frequency band inputted from the sound power calculator 21 with the power of the first formant inputted from the first formant power calculator 22, calculates the ratio thereof, and outputs the result to the determination component 28.

Meanwhile, just as in Embodiment 2, the sound signal inputted from the microphone 8 is inputted in parallel to the speech detector 25 and the speech rate calculator 26. The speech detector 25 determines whether or not the inputted sound signal includes a human voice, and outputs the result to the determination component 28. The speech rate calculator

26 measures the amplitude speed from the inputted sound signal, calculates the speech rate as a result, and outputs this to the determination component 28.

The determination component 28 decides whether to activate or deactivate the dichotic function, and controls the switch 19, on the basis of the speech rate and the power ratio of the first formant.

FIG. 9 is a table showing an example of criteria for deciding whether to activate or deactivate the dichotic function on the basis of the speech rate and the power ratio of the first formant.

In this example, the speech rate is classified into three levels: fewer than 8 words per second, from 8 to 12 words per second, and more than 12 words per second. The power ratio is also classified into three levels: less than ⅓, from ⅓ to ⅔, and more than ⅔. These classifications are compiled in a matrix-like table and are variously combined, with combinations with a high risk of masking occurring being entered as "high risk," and those with a low risk of masking occurring as "low risk."

More specifically, if the power ratio is less than ⅓, there is a low risk of masking occurring due to the speech rate, but if the power ratio is over ⅔, there is a high risk of masking occurring, regardless of the speech rate. Also, when the power ratio is between ⅓ and ⅔, the risk of masking occurring varies with the speech rate.

The determination component 28 determines the differences under these conditions, activates the dichotic function in a "high risk" state, and deactivates the dichotic function in a "low risk" state.

Thus, hearing is improved since more precise control of the activation or deactivation of the dichotic function can be carried out in a combination of Embodiment 1 and Embodiment 2.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

The hearing aid device disclosed herein can be utilized as a hearing aid device used by people with hearing impairment.

REFERENCE SIGNS LIST

1 hearing aid device
2 sound input/output component (for right ear)
3 sound input/output component (for left ear)
4 lead wire
5 lead wire
6 signal processor
7 display component
8 microphone
9 speaker
10 microphone
11 speaker
12 band analyzer
13 gain controller
14 band synthesizer band analyzer
16 gain controller
17 band synthesizer
18 dichotic setting component
19 switch first formant extractor
21 sound power calculator
22 first formant power calculator
23 ratio calculator
24 determination component speech detector
26 speech rate calculator
27 determination component
28 determination component
218 dichotic setting component
318 dichotic setting component

What is claimed is:

1. A hearing aid device with a dichotic function comprising:

a first sound input/output component including a first microphone configured to be worn on one ear of a user of the hearing aid device;

a second sound input/output component including a second microphone configured to be worn on the other ear of the user; and a dichotic setting component configured to determine whether masking has occurred, according to a sound signal inputted from the first microphone or the second microphone, and either activate the dichotic function when it is determined that masking has occurred so as to apply the dichotic function to correct the masking, or deactivate the dichotic function when it is not determined that masking has occurred, wherein the dichotic setting component includes:

a speech detector configured to determine whether or not the sound signal inputted from the first microphone or the second microphone includes a human voice; and a speech rate calculator configured to calculate a speech rate at which the human voice included in the sound signal is spoken, wherein when the speech detector has determined that a human voice is included in the sound signal, the dichotic setting component determines the occurrence of masking according to the speech rate calculated by the speech rate calculator.

2. The hearing aid device according to claim 1, wherein the dichotic setting component:

determines that masking has occurred when the speech detector has determined that a human voice is included in the sound signal, and the speech rate calculated by the speech rate calculator has been determined to be higher than a predetermined rate.

3. The hearing aid device according to claim 1, wherein the dichotic setting component is configured to determine whether masking has occurred by extracting from the sound signal an envelope of the sound signal and calculating a period of the envelope within a predetermined time.

4. A hearing aid device with a dichotic function comprising:

a first sound input/output component including a first microphone configured to be worn on one ear of a user of the hearing aid device;

a second sound input/output component including a second microphone configured to be worn on the other ear of the user; and a dichotic setting component configured to determine whether masking has occurred, according to a sound signal inputted from the first microphone or the second microphone, and either activate the dichotic function when it is determined that masking has occurred so as to apply the dichotic function to correct the masking, or deactivate the dichotic function when it is not determined that masking has occurred, wherein the dichotic setting component includes:

a sound power calculator configured to calculate a power of the sound signal;

a first formant extractor configured to extract a first formant from the sound signal;

a first formant power calculator configured to calculate a power of the first formant extracted by the first formant extractor; and a ratio calculator configured to calculate a ratio of the first formant to the sound signal from a result of calculation by the sound power calculator and the first formant power calculator, and the dichotic setting component is further configured to:

determine an occurrence of frequency masking from the ratio of the first formant to the sound signal, wherein in determining whether masking has occurred, the dichotic setting component determines that masking occurs when it is determined that frequency masking occurs.

5. A hearing aid device with a dichotic function comprising:

a first sound input/output component including a first microphone configured to be worn on one ear of a user of the hearing aid device;

a second sound input/output component including a second microphone configured to be worn on the other ear of the user; and a dichotic setting component configured to determine whether masking has occurred, including at least one of time masking and frequency masking, on the basis of a sound signal inputted from the first microphone or the second microphone, activate the dichotic function when the dichotic setting component has determined that the masking has occurred, so as to apply the dichotic function to correct the detected masking, and deactivate the dichotic function when the dichotic setting component has determined that masking has not occurred, wherein the dichotic setting component is configured to:

calculate a rate of speech of a human voice included in the sound signal inputted from the first microphone or the second microphone, and activate the dichotic function when the rate of speech is higher than a predetermined rate.

6. A hearing aid device with a dichotic function comprising:

a first sound input/output component including a first microphone configured to be worn on one ear of a user of the hearing aid device;

a second sound input/output component including a second microphone configured to be worn on the other ear of the user; and a dichotic setting component configured to determine whether masking has occurred, including at least one of time masking and frequency masking, on the basis of a sound signal inputted from the first microphone or the second microphone, activate the dichotic function when the dichotic setting component has determined that the masking has occurred, so as to apply the dichotic function to correct the detected masking, and deactivate the dichotic function when the dichotic setting component has determined that masking has not occurred, wherein the dichotic setting component is configured to:

calculate a ratio of a first formant to the sound signal inputted from the first microphone or the second microphone, and activate the dichotic function when the ratio of the first formant to the sound signal is greater than or equal to a predetermined value.

7. The hearing aid device according to claim 5, wherein the dichotic setting component is configured to:

calculate a rate of speech of a human voice included in the sound signal inputted from the first microphone or the second microphone, calculate a ratio of a first formant to the sound signal, and activate the dichotic function when the rate of speech is higher than a predetermined rate and the ratio of the first formant to the sound signal is greater than or equal to a predetermined value.

* * * * *